United States Patent [19]

Smythe

[11] Patent Number: 4,521,462

[45] Date of Patent: Jun. 4, 1985

[54] ROTARY ATOMIZER FOR COATING WORKPIECES WITH A FINE LAYER OF LIQUID MATERIAL, AND A METHOD OF OPERATING THE SAID ATOMIZER

[75] Inventor: Kenneth R. Smythe, Farnborough, United Kingdom

[73] Assignee: Sale Tilney Technology Plc., Weybridge, United Kingdom

[21] Appl. No.: 635,619

[22] Filed: Jul. 30, 1984

[30] Foreign Application Priority Data

Aug. 2, 1983 [GB] United Kingdom ..... 8320827

[51] Int. Cl.[3] ..... B05D 1/02

[52] U.S. Cl. ..... 427/421; 118/300; 118/323; 239/703; 239/223; 239/224

[58] Field of Search ..... 118/300, 317, 323; 239/703, 223, 224; 427/421

[56] References Cited

U.S. PATENT DOCUMENTS 3,001,890 9/1961 Sedlacsik ..... 239/703 X
3,221,992 12/1965 Sedlacsik ..... 239/703 X
4,214,708 7/1980 Lacchia ..... 239/703
4,337,895 7/1982 Gallen ..... 239/223 X

*Primary Examiner*—Shrive P. Beck
*Attorney, Agent, or Firm*—Kerkam, Stowell, Kondracki & Clarke

[57] ABSTRACT

A rotary atomizer for coating workpieces with a fine layer of liquid material, and a method of operating the said atomizer.

A rotary atomizer (10) for coating workpieces with a fine layer of liquid material fed at very low flow rates includes a bell-type rotatable atomizing device (12) for dispensing the liquid from an edge (17) in an atomized condition under the effect of centripetal forces. The liquid fed into a tube (21) having an outlet (20) within the bell (12) appears as discontinuous drops (40) at the outlet (20). Air is also fed into the bell (12) via a tub (25) having an outlet (26) disposed adjacent the liquid outlet (20) such that the air jet (41) breaks up the drops (40) and forms a spray (42) directed at the internal wall of the bell (12). The spray (42) coalesces into a continuous film of liquid as it travels on the internal wall of the bell (12) to the discharge edge (17).

9 Claims, 3 Drawing Figures

Figure 1:
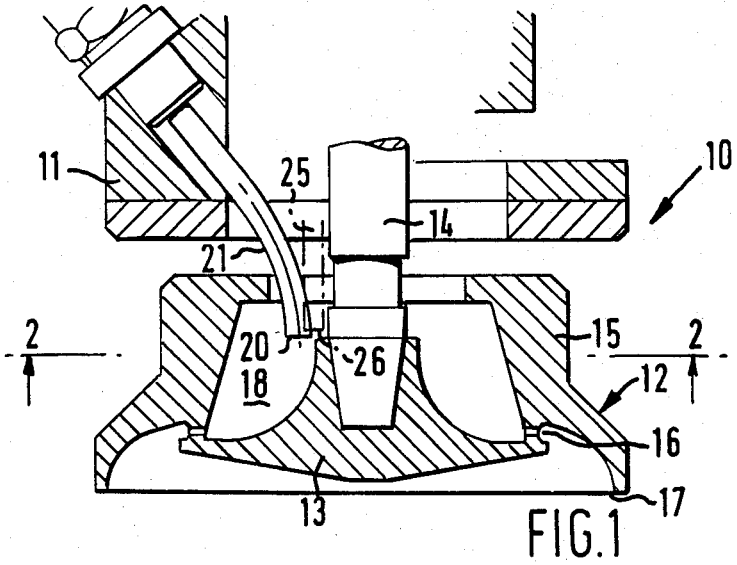

ROTARY ATOMIZER FOR COATING WORKPIECES WITH A FINE LAYER OF LIQUID MATERIAL, AND A METHOD OF OPERATING THE SAID ATOMIZER

The present invention concerns a rotary atomizer for coating workpieces with a fine layer of liquid material, and a method of operating the said atomizer. Although the invention is not so restricted, it will hereafter be particularly described with reference to a rotary atomizer for use in aluminium strip finishing lines, e.g. for coating aluminium strip before it is made into cans for containing beverages.

When coating can material with a protective layer of wax or an oil, such as e.g. dioctyl sebacate, it is very important to keep the layer to very fine dimensions, i.e. to keep the layer very thin and moreover to make the layer of uniform thickness. But with known atomizers this is very difficult to achieve because thinness of the layer implies very low flow rates of the coating liquid and very low flow rates in turn imply a risk of unevenness of the coating. At very low flow rates of the liquid coating, the flow becomes intermittent and drips appear at the outlet orifice. The exact numerical value for the formation of drips varies with the viscosity and surface tension of the liquid, but a flow rate of 7 $cm^3$/min is typical.

When constant flow ceases and drips appear, the spray pattern from known rotary atomizers pulses at intervals coincident with the drips forming. This results in eneven coating.

Of course, rotary atomizers have been well-known for a long time. Generally, they include a motor-driven or turbine-driven member, variously called a bell, cup or disc having a fast-rotating dispensing edge from which the coating material is dispensed in spray form under the effect of the centripetal forces. It is known also in rotary atomizers to provide air jets or streams around the dispensing edge to control the shape of the spray and3or to assist in atomization.

Furthermore, it is known from GB-A-2 086 765 to reduce any maldistribution of coating material under the effect of a partial vacuum caused by the high-speed rotation of a turbine-type atomizer by supplying air into the spray along the axis of rotation of the atomizer. However, this air enters the spray downstream of the dispensing edge, i.e. outside the atomizer, and has no influence whatsoever on the liquid *within* the cup or bell. The outlet of the air supply and the outlet within the cup or bell of the paint tube in GB-A-2 086 765 are spatially well separated and have absolutely no interaction.

None of the known atomizers addresses itself to, or is capable of solving the problem of uneven coating arising at very low liquid coating material feed rates.

The present invention seeks to overcome the problem of uneven coating at low feed rates of the coating material by providing a rotary atomizer, and a method of operating it, as set out below. It will be seen that, essentially, a small amount of air (or other gas) is used to break the surface tension of the coating material as it emerges inside the bell from its feed tube. The drips from the feed tube are changed into smaller droplets, mixed with the air, and the mix or spray is then transferred to the internal wall of the rotating atomizer to travel to the edge under the centrifugal force as a coherent or quasi-coherent film, to be discharged from the edge in a constant spray pattern.

According to one aspect of the present invention, there is provided a rotary atomizer for coating workpieces with a fine and even layer of liquid coating material, comprising an atomizing device having a discharge edge, means for rotating said atomizing device, a liquid feed tube connectible to a source of coating liquid and terminating in an outlet within said atomizing device, and means for controlling the rate of flow of said liquid in the feed tube such that the flow is intermittent. The invention is characterised in that there is provided a gas or air supply tube having an outlet disposed adjacent the outlet of the liquid tube within the atomizing device and connectible to a source of pressurized gas or air, the relative positions of said outlets being such that in use a regulated stream of gas or air is directed at or adjacent the liquid outlet so as to break up drips of said liquid appearing at the outlet into smaller droplets and deflect them towards the internal wall of the said atomizing device upstream of said dispensing edge.

Preferably, the outlet of the liquid feed tube and the outlet of the said supply tube are not coplanar, the latter terminating somewhat upstream of the former. Although the said supply tube could surround the said feed tube, in a preferred embodiment the two tubes are discrete tubes extending into the atomizing device at circumferentially spaced apart positions and with their respective longitudinal axes inclined to each other at an acute angle.

According to another aspect of the present invention, there is provided a method of coating workpieces with a liquid at very low outputs by utilizing a rotary atomizer, comprising providing a liquid feed tube terminating in an outlet disposed within the rotary atomizing device, e.g. bell, of said atomizer, supplying the feed tube with said liquid at a rate such that flow of said liquid is intermittent and drops form at the outlet of the feed tube. This method is characterized by directing a stream of gas or air at said outlet within said atomizing device to break up the drops into smaller droplets and to transfer them to the internal wall of the said device, e.g. bell, to be discharged from the discharge edge thereof in a substantially uniform spray pattern.

Advantageously, the rate of flow of liquid may not exceed 7 cubic centimeters per minute, and the air or gas pressure is less than $70\times10^3$ P; most typically 2–3 pounds per square inch ($14–21\times10^3$ P).

Figure 2:
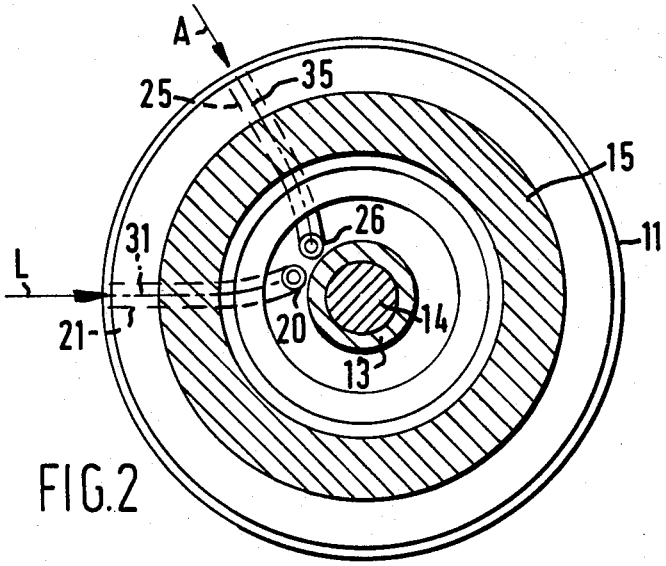
Figure 3:
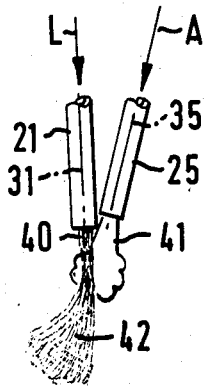

The invention is illustrated, purely by way of example, with reference to the accompanying diagrammatic drawing, wherein:

FIG. 1 is a longitudinal section of part of a rotary atomizer according to the invention, FIG. 2 is cross-section taken along the plane indicated by the lines 2—2 in FIG. 1, and FIG. 3 is an enlarged schematic detail to illustrate the operation of the rotary atomizer.

In the drawing, a rotary atomizer 10 includes a housing 11, shown only partially, to the front end of which is secured an atomizing device 12. The device 12 consists of a mushroom-shaped boss 13 secured to the end of a shaft 14 projecting from the housing 11 and in use rotated at high speed, e.g. 30,000 r.p.m., by a motor or turbine, not shown. The boss 13 is unitary with a generally cup-shaped member 15, hereafter referred to as 'bell 15'.

A row of circumferential holes 16 is formed at the junction of the radially outer edge of the head of the boss 13 and a projection on the internal wall of the bell 15. The downstream edge 17 of the bell 15 is a sharp discharge edge. The stem of the boss 13 and the internal wall of the bell 15 form an annular chamber 18. Into this chamber 18 extends the outlet 20 of a feed tube 21 for the liquid coating material, connected at its other end to a source of the liquid and a pump, not shown. The direction of flow of the liquid along the feed tube 21 is indicated by an arrow L in FIGS. 2 and 3.

The apparatus described thus far is conventional.

According to a preferred embodiment of the invention, an air (or other gas) supply tube 25 having an outlet 26 projects into the chamber 18 at a location radially and circumferentially spaced from tube 21. This tube 25 is connected in use to a source of supply delivering air at a relatively low pressure of 2–3 p.s.i. or about $14\text{–}21\times10^3$ pascals.

The relative dispositions of the tube outlets 20 and 26 may be seen most clearly in FIGS. 2 and 3. The longitudinal axes 31, 35 of the tubes 21, 25, respectively intersect each other at an acute angle. The outlet 26 of the air tube 21 terminates axially backwardly (upstream) of the outlet 20 of the liquid feed tube 21. In a typical application, the inner diameter of each tube 21, 25 is 0.24 cm and the axial spacing of the tube outlets 20, 26 is 0.16 cm. This configuration of the tubes and tube outlets has the following effect in use, explained in conjunction with FIG. 3:

When liquid is fed in the direction L along the tube 21 at very low feed rates of 7 $cm^3$/min., the flow is intermittent. Drops of liquid appear at the outlet 20. Air flowing in the pipe 25 along the direction of arrow A issues from outlet 26 (illustrated schematically at 41) and intersects the pattern 40 of the liquid. More particularly the air jet 41 shears the drips of liquid off the outlet 20 of the tube 21 and forms a spray which is deflected from the direction of the axis 31 of the tube 21 towards the outer wall of the chamber 18 (FIG. 1). The spray then impinges on the outer wall of the chamber 18 and coalesces into a thin, coherent or quasi-coherent film. This film then travels under the effect of the centripetal forces through the bores 16 to the discharge edge 17, from where it is discharged as a uniform spray. In this way, the above-mentioned pulsing and uneven coating due to the low feed rate and drip formation are reliably prevented.

Although the invention has so far been described in terms of a rotary atomizer not employing electrostatic charging of the coating material, it is readily adaptable to include an electrostatic charger.

I claim:

1. A rotary atomizer for coating workpieces with a fine and even layer of liquid coating material, comprising an atomizing device having a discharge edge, means for rotating said atomizing device, a liquid feed tube connectible to a source of coatng liquid and terminatng in an outlet within said atomizing device, and means for controlling the rate of flow of said liquid in the feed tube such that the flow is intermittent and produces drops at said outlet, characterised in that there is provided a gas or air supply tube having an outlet disposed adjacent the outlet of the liquid feed tube within the atomizing device and connectible to a source of pressurized gas or air, the relative positions of said outlets being such that in use a regulated stream of gas or air is directed at or adjacent the liquid outlet so as to break up drops of said liquid appearing at the outlet into smaller droplets and deflect them towards the internal wall of the said atomizing device upstream of said discharge edge.

2. A rotary atomizer according to claim 1, characterized in that the outlet of the liquid feed tube and the outlet of the said air or gas supply tube are not coplanar, the latter terminating somewhat upstream of the former to promote forward projection of the resulting spray.

3. A rotary atomizer according to claim 1, characterized in that the two tubes are discrete tubes extending into the atomizing device at circumferentially spaced apart positions and with their respective longitudinal axes inclined to each other at an acute angle.

4. A rotary atomizer according to claim 1, characterized in that the flow rate of the liquid is adjusted so as not to exceed 7 $cm^3$/min.

5. A rotary atomizer according to claim 1, wherein the pressure of the air or gas is adjusted so as not to exceed 10 p.s.i. ($=70\times10^3$ Pascals).

6. A rotary atomizer according to claim 2, characterized in that the distance between the said outlets is substantially 0.16 cm.

7. A rotary atomizer according to claim 1, characterized in that the inner diameter of each tube is substantially 0.24 cm.

8. A rotary atomizer according to claim 2, characterized in that the two tubes are discrete tubes extending into the atomizing device at circumferentially spaced apart positions and with their respective longitudinal axes inclined to each other at an acute angle.

9. A method of coating workpieces with a liquid at very low outputs by utilizing a rotary atomizer, comprising providing a liquid feed tube terminating in an outlet disposed within a rotary bell of said atomizer, supplying the feed tube with said liquid at a rate such that flow of said liquid is intermittent and drops form at the outlet of the feed tube, characterized by directing a stream of gas or air at said outlet within the bell of said atomizing device to break up the drops into smaller droplets and to transfer them as a spray to the internal wall of the said bell, to be discharged from a discharge edge thereof in a substantially uniform spray pattern.

* * * * *